US009701113B2

(12) United States Patent
Garcia Alvarez et al.

(10) Patent No.: US 9,701,113 B2
(45) Date of Patent: Jul. 11, 2017

(54) METHOD OF CONTROLLING A FLUID FIRING UNIT OF A PRINTHEAD

(71) Applicant: Hewlett-Packard Development Company, L.P., Houston, TX (US)

(72) Inventors: Ana Cristina Garcia Alvarez, Sant Cugat del Valles (ES); Antonio Gracia Verdugo, Sant Cugat del Valles (ES); Mauricio Seras Franzoso, Sant Cugat del Valles (ES)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/027,993

(22) PCT Filed: Oct. 14, 2013

(86) PCT No.: PCT/EP2013/071442
§ 371 (c)(1),
(2) Date: Apr. 7, 2016

(87) PCT Pub. No.: WO2015/055227
PCT Pub. Date: Apr. 23, 2015

(65) Prior Publication Data

US 2016/0250850 A1 Sep. 1, 2016

(51) Int. Cl.
*B41J 2/045* (2006.01)
*B41J 2/165* (2006.01)

(52) U.S. Cl.
CPC ..... *B41J 2/04551* (2013.01); *B41J 2/04586* (2013.01); *B41J 2/165* (2013.01);
(Continued)

(58) Field of Classification Search
CPC ..... B41J 2/165; B41J 2/16517; B41J 2/1652; B41J 2/16526; B41J 2/16579;
(Continued)

(56) References Cited

U.S. PATENT DOCUMENTS 4,245,224 A 1/1981 Isayama et al.
5,418,558 A 5/1995 Hock et al.
(Continued)

FOREIGN PATENT DOCUMENTS

CN 1403283 3/2003
EP 0829354 3/1998
(Continued)

OTHER PUBLICATIONS

Inkjet Printer Cleaning. (2006). Retrieved from http://www.northlight-images.co.uk/article_pages/inkjet_cleaning.html.
(Continued)

*Primary Examiner* — Thinh H Nguyen
(74) *Attorney, Agent, or Firm* — HP Inc.-Patent Department

(57) ABSTRACT

The present disclosure discloses a method implemented by a printer to control a fluid firing unit of a printhead, when said printhead is coupled to the printer, to operate according to any one of a normal printing mode and a recovery mode. According to the method, if the fluid firing unit is operated according to the normal printing mode, a first voltage is applied to the fluid firing unit to fire the fluid firing unit during a printing operation; and if the fluid firing unit is operated according to the recovery mode, a second voltage higher than the first voltage is applied to the fluid firing unit to clean the fluid firing unit.

20 Claims, 3 Drawing Sheets

(52) U.S. Cl.
CPC ..... *B41J 2/1652* (2013.01); *B41J 2/16517* (2013.01); *B41J 2/16526* (2013.01); *B41J 2/16579* (2013.01); *B41J 2002/16561* (2013.01); *B41J 2002/16573* (2013.01)

(58) Field of Classification Search
CPC .... B41J 2002/16561; B41J 2002/16573; B41J 2/04551; B41J 2/04586
See application file for complete search history.

(56) References Cited

U.S. PATENT DOCUMENTS

| | | | |
|---|---|---|---|
| 5,711,619 A | 1/1998 | Kaneko et al. | |
| 5,757,396 A * | 5/1998 | Bruner | B41J 2/16517 347/12 |
| 6,036,299 A | 3/2000 | Kobayashi et al. | |
| 6,447,091 B1 | 9/2002 | Calvo et al. | |
| 6,536,865 B2 | 3/2003 | Sarmast | |
| 6,814,422 B2 | 11/2004 | Bruch et al. | |
| 6,820,958 B2 | 11/2004 | Miyakoshi | |
| 6,837,636 B2 | 1/2005 | Sawyer et al. | |
| 2009/0073214 A1 | 3/2009 | Tojo et al. | |
| 2010/0214597 A1 | 8/2010 | Hasseler et al. | |
| 2012/0163835 A1 | 6/2012 | Sasai et al. | |

FOREIGN PATENT DOCUMENTS

| | | |
|---|---|---|
| EP | 1287996 | 3/2003 |
| JP | S5945163 | 3/1984 |

OTHER PUBLICATIONS

PCT Search Report and Written Opinion, Feb. 13, 2014, PCT/EP2013/071442, Hewlett-Packard Development Company, Ltd., European Patent Office, 13 pages.

* cited by examiner

METHOD OF CONTROLLING A FLUID FIRING UNIT OF A PRINTHEAD

CROSS-REFERENCE TO RELATED APPLICATION

This application is a U.S. National Stage Application of and claims priority to International Patent Application No. PCT/EP2013/071442, filed on Oct. 14, 2013, and entitled "METHOD OF CONTROLLING A FLUID FIRING UNIT OF A PRINTHEAD," which is hereby incorporated by reference in its entirety.

BACKGROUND

In the field of printers, fluid firing units of a printhead are designed to fire printing fluid through nozzles in accordance with a voltage which can be applied on the units.

If these fluid firing units remain idle over a long period of time, there is an increasing risk that printing fluid in the fluid firing units becomes dry, thereby blocking these fluid firing units and preventing any further printing operation.

Therefore, the fluid firing units need to be cleaned during a recovery operation to keep the fluid firing units healthy and to ensure they remain operational, in order to maintain a good image quality over the printer's life time.

DETAILED DESCRIPTION

As explained in more detail later in reference to FIGS. 1A and 1B, a fluid firing unit of a printhead is designed to fire printing fluid through a nozzle in accordance with a voltage which can be applied on said unit. The printing fluid can be for example an ink, a pre-treatment fluid or a post-treatment fluid, such as varnish.

As indicated above, fluid firing units of a printer require to be cleaned on a regular basis to maintain a good image quality over the printer's life time. If fluid firing units remain idle over a long period of time (e.g. because no printing is performed), there is an increasing risk that printing fluid in the fluid firing units becomes dry, thereby blocking these fluid firing units and preventing any further printing operation.

It is therefore necessary to clean the fluid firing units during a recovery operation to keep the fluid firing units healthy and to ensure they remain operational. Such a recovery operation is aimed at removing any solids, dried particles or external contaminants that may have entered or have been formed inside the cavities of the fluid firing units.

Fluid firing units recovery performance in printers is not always satisfactory as they may not eliminate dried printing fluid or other solids blocking the fluid firing units. This issue has become even more critical with the growing use of some newer ink formulations. For example, inks with specific components like latex or wax are now frequently used by printers to increase image durability. These specific components imply that the ink is more difficult to be removed.

It has been observed that the normal operating voltage applied to the fluid firing units is not adapted to a recovery mode during which fluid firing units are to be cleaned, since applying such voltage does not allow any solids, dried particles, external contaminants, or the like, that have entered or have been formed inside the cavities of the fluid firing units to be expelled properly.

Consequently, recovery procedures are more time consuming, the printhead cleaning kit life shorter and printing fluid wastage increased. Furthermore, the fluid firing unit life is usually shorter and the image quality generally decreases faster.

Examples of the present disclosure intend to improve the fluid firing unit recovery performance, notably when such aforementioned ink formulations are being used for printing operation.

Figure 1A:
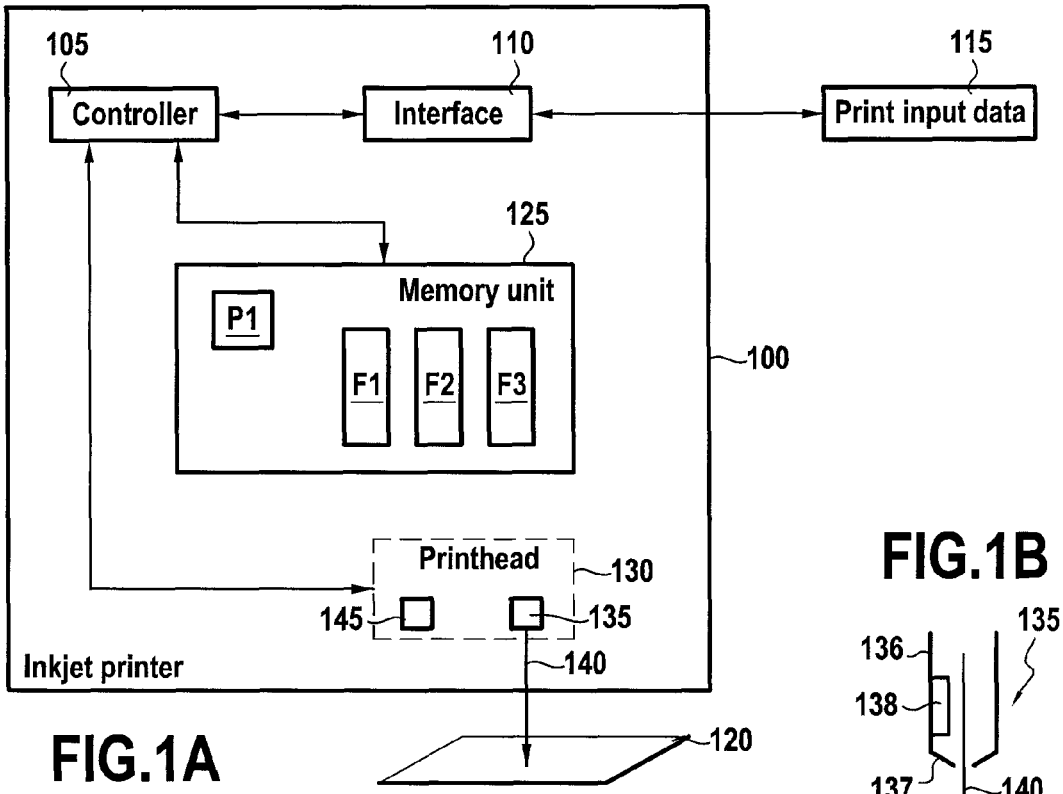
FIG. 1A represents a printer according to a particular example of the present disclosure.

FIG. 1A schematically shows an example of a printer 100 (of the inkjet type in this example, such as a thermal inkjet printer, a piezo inkjet printers or another type of inkjet printers). The printer 100 includes a controller 105 which can receive, using an interface unit 110, print input data 115 to be printed upon a substrate 120, from a computer system or some other device, such as a scanner or fax machine. One function of the controller 105 is to control, in accordance with print input data 115, voltages which may be applied to the fluid firing units of a printhead for the purpose of printing. Applying a normal operating voltage to a fluid firing unit triggers firing during a printing operation.

The interface unit 110 facilitates the transfer of data and command signals to controller 105 for printing purposes. The substrate 120 may be any sort of sheet-like or web-based medium, including paper, cardboard, plastic and textile.

Moreover, printer 100 includes a memory unit 125 interacting with the controller 105. The memory unit 125 includes, for example, a computer memory such as a solid-state RAM and a non-volatile rewritable memory (such as an EEPROM for instance).

Figure 2:
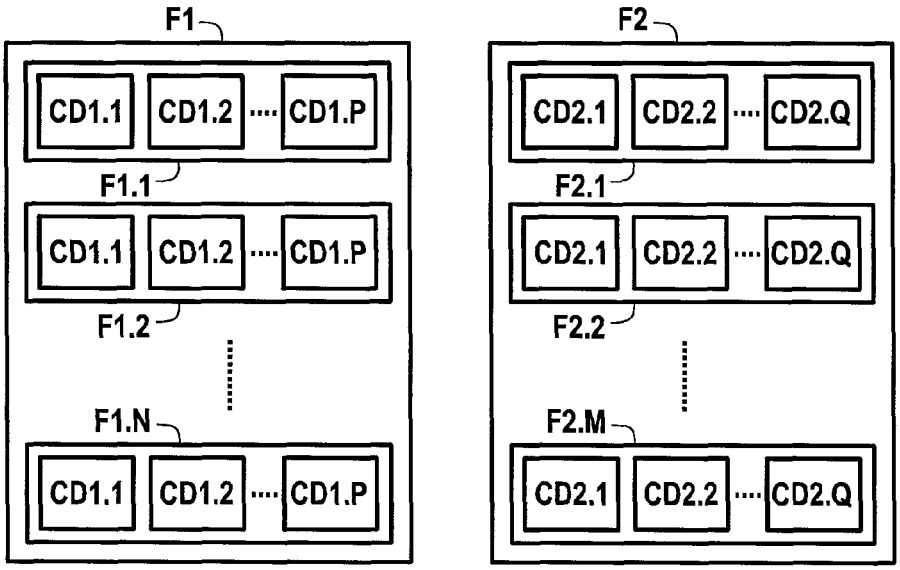
FIG. 2 represents a first file and a second file stored into the memory of a printer according to a particular example of the present disclosure.

In this particular example, the non-volatile rewritable memory stores a first file F1, a second file F2 and a third file F3. Alternatively, any one of files F1, F2 and F3 can be stored in a memory external to the printer 100. In that alternative case, the controller 105 is capable of consulting any of these remote files to retrieve some desired information (the first file F1 and the second file F2 are shown in more detail in FIG. 2 and will be described later). The non-volatile rewritable memory constitutes a recording medium according to the present disclosure, readable by the controller 105, and on which is stored a computer program P1 according to the present example, this computer program P1 including instructions for carrying out a method to control a fluid firing unit according to an example of the present disclosure. In a variant, a terminal connected to the printer 100 may run a computer program to cause the controller 105 to operate according to the present example.

The printer 100 includes one or multiple printhead 130 and each printhead 130 includes one or multiple fluid firing unit 135. Each fluid firing unit 135 can be triggered by the controller 105 to eject printing fluid drops 140 so as to print upon the substrate 120. The number of fluid firing unit 135 in a printhead may, for instance, be in the region of a hundred, one thousand or more, depending on the particular printhead.

A printhead 130 can be selectively coupled to and removed from the printer 100 to allow fluid firing unit 135 replacement when necessary. When the printhead 130 is coupled to the printer 100 (in working position), the fluid firing unit 135 operates according to the voltage applied by controller 105.

Furthermore, the printer 100 includes detection means 145 (or detector 145) to detect predetermined conditions. For example, this detection means 145 can be arranged within or in the vicinity of the printhead 130.

Figure 1B:
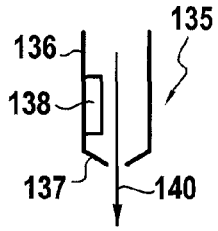
FIG. 1B represents a fluid firing unit of a printhead according to a particular example of the present disclosure.

FIG. 1B schematically shows an example of fluid firing unit 135. The fluid firing unit 135 comprises a firing chamber 136 and a nozzle 137. Furthermore, the fluid firing unit 135 comprises a resistor element 138 located inside the firing chamber 136. In this example, the controller 105 applies voltages to the fluid firing unit 135 and, more specifically, to the resistor element 138 in order to fire the firing chamber 136 and the nozzle 137 during a printing operation, or during a cleaning operation to clean the firing chamber 136 and the nozzle 137. As a result, the resistor element 138 heats and boils printing fluid in the firing chamber 136, which causes a bubble nucleation. Then, the bubble of vapour continues to grow, filling the firing chamber 136 like an expanding balloon and thus driving a droplet of printing fluid out of the nozzle 137.

The examples of the present disclosure are described in more details below in relation with the particular arrangement of fluid firing unit 135 of FIG. 1B. However, it should be understood that other arrangements of fluid firing unit 135 may be contemplated in the scope of the present disclosure.

Figure 3:
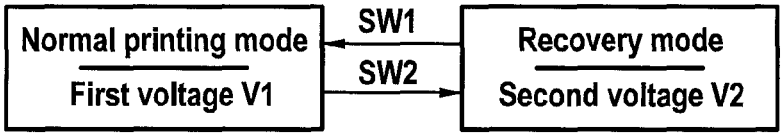
FIG. 3 represents a normal printing mode and a recovery mode according to a particular example of the present disclosure.

As described in more details later, the printer 100 carries out a method to control a fluid firing unit 135 of a printhead 130 according to a particular example of the present disclosure, when the printhead 130 is coupled to the printer 100, to operate according to any one of a normal printing mode and a recovery mode (FIG. 3). In some cases, a printer may be able to print according to different configurations, sometimes called "print mode" (such as a draft printing mode, a standard printing mode or an optimal quality printing mode for instance). The normal printing mode in the sense of the present disclosure can be any such configurations according to which the printer 100 may carry out a printing operation. According to this disclosure, if the fluid firing unit 135 is operated according to the normal printing mode, a first voltage V1 is applied to the fluid firing unit 135 to fire the fluid firing unit 135 during a printing operation. Furthermore, if the fluid firing unit 135 is operated according to the recovery mode, a second voltage V2, higher than the first voltage V1, is applied to the fluid firing unit 135 to clean the fluid firing unit 135.

In the example of FIG. 3, the printer 100 can switch (SW1) from the normal printing mode to the recovery mode, and conversely (SW2). In a particular example, the printer 100 can also operate in another mode, such as in a pause mode for instance, according to which no voltage is applied to a particular fluid firing unit 135.

A method to control a fluid firing unit 135 according to an example of the present disclosure will now be described in reference to FIG. 4.

More specifically, the printer 100 carries out the method of this first example to control a fluid firing unit 135 by executing the computer program P1 stored in the non-volatile rewritable memory.

During an initial voltage calibration (S1), for instance a factory calibration, a voltage range is determined to allow correct operation of the fluid firing unit 135 of the printer 100. Furthermore, an optimal value of voltage V0 is also determined during this initial voltage calibration. This optimal value allows the fluid firing unit 135 to optimize printing performance and image quality by ensuring correct drop size and directionality.

Then, when a new printhead 130 is inserted in the printer 100 (S2), the controller 105 performs an additional voltage calibration (S3). During this additional voltage calibration, a value of the first voltage V1 is determined. The value of this first voltage V1 is equal to a first additional value added to the optimal value of voltage V0. This first additional value is determined to compensate the losses of voltage along the printer circuitry and thus ensure that the first voltage V1 applied to the fluid firing unit 135 matches the optimal value of voltage V0, in order to optimize printhead 130 printing performance.

In a particular example, the first additional value is determined in such a way that the energy (E1) provided to the fluid firing unit 135 by application of first voltage V1 is fifteen percent higher than a minimum energy ensuring that all the fluid firing units 135 fire a drop meeting optimal speed and size. This first additional value guarantees that the energy E1 is sufficient to fire fluid firing unit 135 over the printhead 130 life, despite the degradation with usage of the resistor element 138 in the fluid firing unit 135 and the increase of energy necessary over printhead 130 life. The value of the energy E1 is for instance determined during empirical tests and simulations using modelling tools. The simulations take into consideration the resistor element 138 material and the environmental conditions such as the temperature and the humidity that the resistor element 138 undergoes over his life. During empirical tests, printheads can be run over their life time under the most stringent firing conditions and during a number of firings that their life goals require. Thus, the value of the energy E1 determined during empirical tests and simulations ensures that the fluid firing unit 135 continues being fired at the end of the printhead 130 life.

The initial and additional voltage calibrations are already known in the art and will therefore not be described in more details in this document. In one example of the present example, any one of S1, S2 and S3 is not performed. The value of first voltage V1 may be set manually by a user.

As indicated earlier, the controller 105 controls the voltage applied to the fluid firing unit 135, thereby providing a corresponding energy to the fluid firing unit 135. In this example, the relationship between the energy provided to the fluid firing unit 135 and the voltage applied to the fluid firing unit 135 is as follows:

$$\text{Energy} = \frac{\text{Voltage}^2 \cdot \text{Time}}{\text{Resistance}},$$

where "Energy" is the energy provided to the fluid firing unit 135, "Voltage" is the voltage applied to the fluid firing unit 135, "Time" is the time over which the voltage is applied to the fluid firing unit 135 and "Resistance" is the electrical resistance of the resistor element 138 of the fluid firing unit 135.

Thus, the higher the voltage applied to the fluid firing unit 135, the higher the energy provided to the fluid firing unit 135.

When the controller 105 receives print input data 115 using the interface unit 110 (S4), it starts operating according to the normal printing mode (S5).

In a normal printing mode, the printer 100 responds to received print input data 115 by printing full color or black print images on substrate 120. The print input data 115 received at interface 110 includes, for example, information specifying printed characters and/or images for printing.

More specifically, according to the normal printing mode, the controller 105 applies the first voltage V1 to the fluid firing unit 135 to fire the fluid firing unit 135 during a printing operation. By applying an optimized value of the first voltage V1, appropriate printing fluid drops are ejected by the fluid firing unit 135. As indicated above, in this particular example, the value of the first voltage V1 is determined in the additional voltage calibration S3.

On a regular basis, the controller 105 checks using the detection means 145 whether a predetermined condition CD1.1-CD1.P is met (P is an integer equal to 1 or more). This predetermined condition CD1.1-CD1.P defines when it is necessary for the fluid firing unit 135 to operate according to the recovery mode to proceed with an operation of cleaning.

The predetermined condition CD1.1-CD1.P is for instance defined so as to trigger the recovery mode if the likelihood of having a blocked fluid firing unit 135 exceeds a predetermined threshold.

In the present example, the first file F1 includes multiple first sets F1.1 to F1.N (named collectively SF1) of so-called predetermined conditions CD1.1-CD1.P (FIG. 2), where N is an integer equal to 1 or more. Each first set F1.1-F1.N of predetermined conditions includes one or several predetermined conditions CD1.1-CD1.P. In another example, the first file F1 includes only one first set of predetermined conditions CD1.1-CD1.P.

In a particular example, the predetermined conditions CD1.1-CD1.P can be any one of:

- the detection of the insertion of a new printhead 130 in the printer 100 (when a new printhead 130 is inserted in the printer 100, this new printhead 130 has never been used and many fluid firing units 135 may be blocked),
- the detection of an idle time of the fluid firing unit 135 exceeding a first predetermined time threshold (when the idle time of the fluid firing unit 135 exceeds a first predetermined time threshold, many fluid firing unit 135 are likely to get blocked because of printing fluid drying and cavity obstructions due to solids and so on), and
- the detection of an uncap time during which the printhead 130 is uncapped exceeding a second predetermined time threshold (a capping station seals the printhead 130 with a rubber around the fluid firing unit 135 to keep the printhead 130 wet, so when an unexpected failure, such as a software error, a carriage crash against media or any other physical obstacle, occurs, leaving the printhead 130 out of a capping station, the fluid firing unit 135 get dried).

Each first set F1.1-F1.N of predetermined conditions CD1.1-CD1.P can include any one of the examples above or a combination thereof.

In this example, the detection means 145 includes one sensor for each predetermined condition. As indicated below, said sensor is a timer when a time is measured. Thus, the controller 105 determines (S6) using each sensor of the detection means 145 whether each predetermined condition CD1.1-CD1.P of any particular first set F1.1-F1.N in F1 is met.

For instance, detecting means 145 includes:

- a sensor to detect the insertion of a new printhead 130 (i.e. to detect coupling of this new printhead 130 with the printer 100),
- an activity timer to detect how long a fluid firing unit 135 remains in the idle state (no printing in progress), and
- an uncap timer to detect how long a fluid firing unit 135 in a printhead 130 remains uncapped.

When the controller 105 determines (S6) that all predetermined conditions CD1.1-CD1.P of a first set F1.1-F1.N in F1 is met, it determines that fluid firing unit 135 is to be cleaned. However, as indicated above, the fluid firing unit 135 recovery performances in the conventional printers are often unsatisfactory. As has been previously mentioned, in conventional systems it has been observed that the energy provided to the fluid firing unit is insufficient to allow all the solids to be removed from the fluid firing units' cavities. In other words, the first voltage V1 is not adapted to the purpose of the recovery mode.

According to examples of the present disclosure, upon determining (S6) that all predetermined conditions CD1.1-CD1.P of a particular first set F1.1-F1.N in F1 is met, the controller 105 detects that the fluid firing unit 135 is to be operated according to the recovery mode. In this example, the controller 105 then determines a value of the second voltage V2 which is to be applied to the fluid firing unit 135 according to the recovery mode.

The value of the second voltage V2 to be applied during the recovery mode is higher than the value of the first voltage V1. As explained below, by setting a second voltage V2 higher than said first voltage V1, improved fluid firing unit 135 recovery performances can be achieved.

In this example, the value of the second voltage V2 can be determined based on the information stored in any one of the second file F2 and the third file F3.

More specifically, the second file F2 includes multiple second sets F2.1-F2.M (named collectively SF2) of predetermined conditions CD2.1-CD2.Q, where M and Q are integers equals to 1 or more. Each second set F2.1-F2.M of predetermined conditions CD2.1-CD2.Q includes one or several predetermined conditions CD2.1-CD2.Q, each second set F2.1-F2.M being associated with a respective value of said second voltage V2.

In another example, the second file F2 includes only one second set of predetermined conditions CD2.1-CD2.Q.

Each predetermined condition CD2.1-CD2.Q can be any one of:

- a predetermined condition CD1.1-CD1.P,
- a printing history stored in the third file F3, or
- another predetermined condition, such as the type of the printer 100, the type of the printhead 130, the printing fluid type fired by the fluid firing unit 135 in the normal printing mode, or ambient conditions of the printer 100, such as the temperature.

Each second set F2.1-F2.M of predetermined conditions CD2.1-CD2.Q can include any one of the examples above or a combination thereof.

As indicated earlier, the relationship in this particular example between the energy provided to the fluid firing unit 135 and the voltage applied to the fluid firing unit 135 is:

$$\text{Energy} = \frac{\text{Voltage}^2 \cdot \text{Time}}{\text{Resistance}}.$$

In an example, the value of this second voltage V2 is set so that the corresponding second energy E2 provided to the fluid firing unit 135 is 20% to 40% higher than the minimum energy ensuring that all the fluid firing unit 135 fire a drop meeting optimal speed and size. Thus, in the case where the first energy E1 is 15% higher than the minimum energy ensuring that all the fluid firing unit 135 fire a drop meeting optimal speed and size, the second energy E2 is set to be 4% to 22% higher than the first energy E1.

In another example, the value of the second voltage V2 can be determined by the controller 105 before the detection of predetermined conditions CD2.1-CD2.Q (S6). In this case, the value of second voltage V2 does not depend upon which predetermined conditions CD2.1-CD2.Q are detected to be met (S6). For instance, the value of second voltage V2 can be set manually by the user or during a calibration (e.g. at S1 or S3).

Upon determining (S6) that that all predetermined conditions CD1.1-CD1.P of a particular first set F1.1-F1.N in F1 is met, the controller 105 suspends (S8) the printing operation and switches (S9) from the normal printing mode to the recovery mode. In another example, the controller 105 completes the printing operation in progress and once the printing operation is completed, switches from the normal printing mode to the recovery mode.

According to the recovery mode, controller 105 causes the second voltage V2 to be applied to the fluid firing unit 135 to clean the fluid firing unit 135.

More specifically, the second energy E2 applied to the fluid firing unit 135 triggers the firing of printing fluid drops in order to eliminate, expel or melt any solid, dried particle, external contaminant that may have entered or have been formed inside the cavities of the fluid firing unit 135.

As mentioned earlier, the value of this second voltage V2 is higher than the value of the first voltage V1, thereby resulting in the second energy E2 being higher than the first energy E1. As a result, the number of printing fluid drops needed to be fire to remove all solids is lower and solids are more efficiently removed from the fluid firing unit 135 in the recovery mode of the present disclosure. Furthermore, a priming operation, during which pressure is applied into the printhead such as the printing fluid is pushed out in order to expel solids, is not needed Therefore, the recovery mode is less time consuming and the printing fluid waste can advantageously be reduced.

S7 and S8 can be performed in any order, or simultaneously.

When appropriate, the controller 105 can cause (S10) the fluid firing unit 135 to resume operation according to the normal printing mode (for instance when the controller 105 receives new print input data 115).

In another example, S7 to S10 are carried out when a manual triggering occurs. For instance, the controller 105 can detect a manual command from the user to enter into the recovery mode. In this case, storing and using the first file F1 is not obligatory.

In another example, the value of the second voltage V2 at S7 is determined based on a manual input from the user. In this case, storing and using the second and third files F2, F3 is not obligatory.

Figure 4:
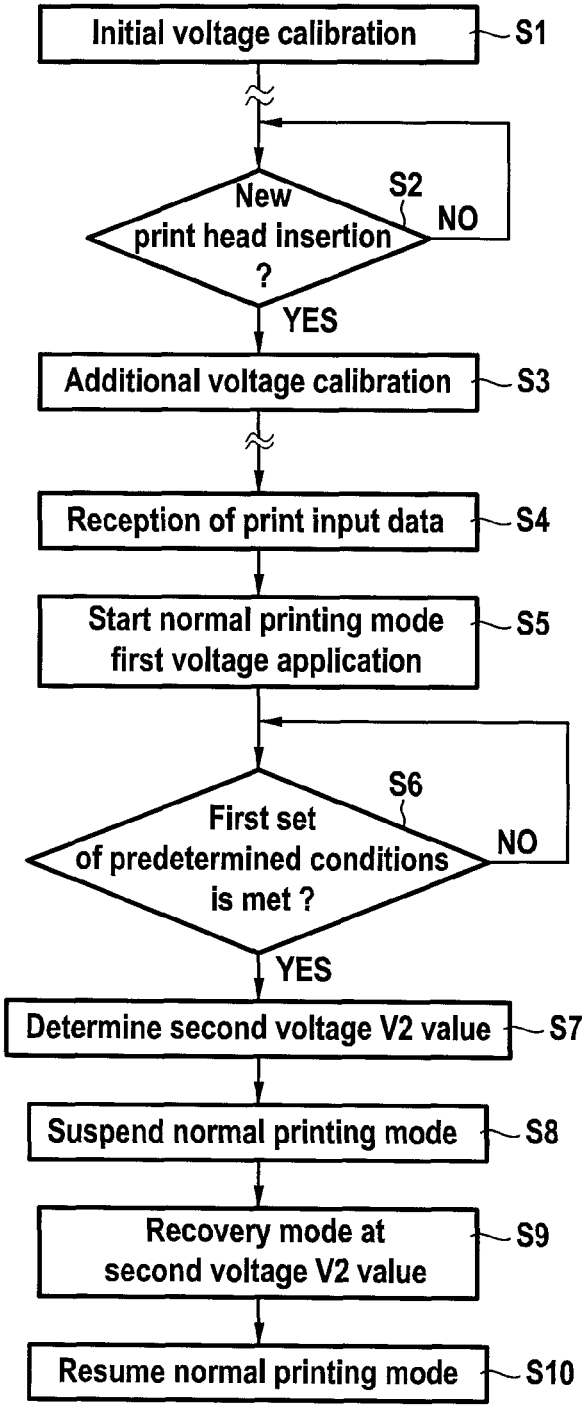
FIG. 4 is a sequence diagram showing the main features of a method to control a fluid firing unit of a printhead according to an example of the present disclosure.
Figure 5:
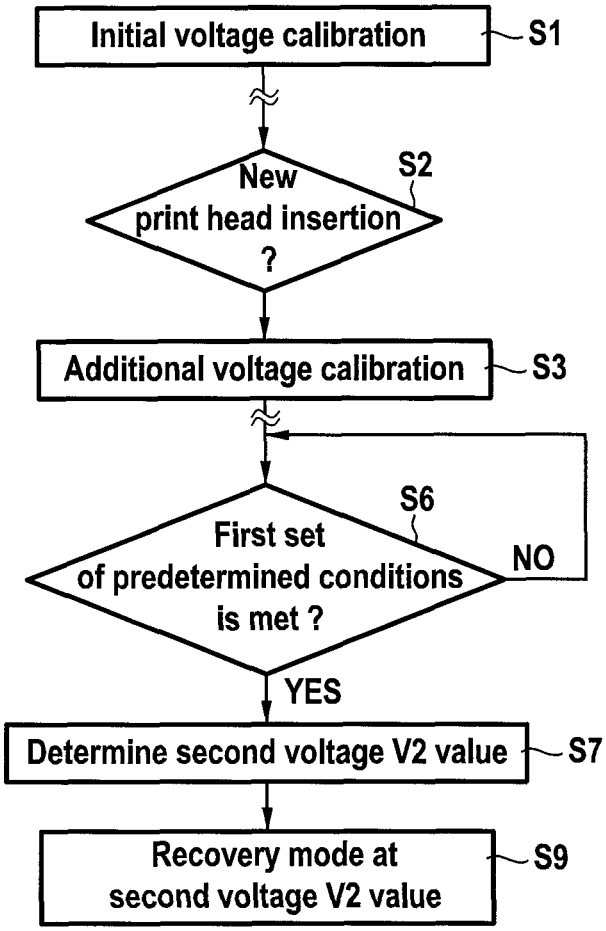
FIG. 5 a sequence diagram showing the main features of a method to control a resistor element of a printhead according to another example of the present disclosure.

FIG. 5 is a diagram showing a variant of the example of FIG. 4, where S1 to S3, S6, S7 and S9 are performed in the same manner as already explained in reference to FIG. 4. In this example, S6, S7 and S9 are operated while the fluid firing unit 135 is not operated according to the normal printing mode. In other terms, the controller 105 may trigger the recovery mode while no print work is in progress. In this case, no switch from the normal printing mode to the recovery mode is necessary.

Accordingly, the present disclosure also provides a computer program on a recording medium, this computer program being arranged to be implemented by the printer 100, and more generally by a controller, this computer program including instructions adapted for the implementation of a method to control a fluid firing unit as described in the present disclosure.

The computer programs of the present disclosure can be expressed in any programming language, and can be in the form of source code, object code, or any intermediary code between source code and object code, such that in a partially-compiled form, for instance, or in any other appropriate form.

The present disclosure also discloses a recording medium readable by the printer, or more generally by a controller, this recording medium including computer program instructions as mentioned above.

The recording medium previously mentioned can be any entity or device capable of storing the computer program. For example, the recording medium can include a storing means, such as a ROM memory (a CD-ROM or a ROM implemented in a microelectronic circuit), or a magnetic storing means such as a floppy disk or a hard disk for instance.

The recording medium of the present disclosure can correspond to a transmittable medium, such as an electrical or an optical signal, which can be conveyed via an electric or an optic cable, or by radio or any other appropriate means. The computer program according to the present disclosure can in particular be downloaded from the Internet or a network of the like.

Alternatively, the recording medium can correspond to an integrated circuit in which a computer program is loaded, the circuit being adapted to execute or to be used in the execution of the printing method of the present disclosure.

The invention claimed is:

1. A method implemented by a printer to control a fluid firing unit of a printhead, the method comprising:

in response to the fluid firing unit being operated according to a normal printing mode, applying a first voltage to a resistor in the fluid firing unit to fire the fluid firing unit during a printing operation; and in response to the fluid firing unit being operated according to a recovery mode, applying a second voltage higher than the first voltage to the resistor in the fluid firing unit to clean the fluid firing unit, wherein applying the second voltage to the resistor causes heating by the resistor of a printing fluid in the fluid firing unit that is higher than heating by the resistor of a printing fluid in the fluid firing unit when the first voltage is applied to the resistor.

2. The method according to claim 1, further comprising operating the fluid firing unit according to the recovery mode in response to determining that a predetermined condition is met.

3. The method according to claim 2, wherein determining that the predetermined condition is met comprises detecting any one of:

insertion of a new printhead within the printer, and an uncap time during which the printhead of coupled to the printer is uncapped exceeding a predetermined time threshold.

4. The method according to claim 1, further comprising setting a value of the second voltage based on information selected from among information relating to the printer, information relating to the printhead, and information relating to a printing fluid used by the printer.

5. The method according to claim 4, wherein the value of the second voltage is set by consulting a file stored in a memory, the file including the information selected from among the information relating to the printer, the information relating to the printhead, and the information relating to a printing fluid used by the printer.

6. The method of claim 4, wherein setting the value of the second voltage is based on information stored in a memory relating to a type of the printer.

7. The method of claim 4, wherein setting the value of the second voltage is based on information stored in a memory relating to a type of the printhead.

8. The method of claim 4, wherein setting the value of the second voltage is based on information stored in a memory relating to a type of the printing fluid used by the printer.

9. The method of claim 4, wherein setting the value of the second voltage is based on information stored in a memory relating to an ambient temperature of the printer.

10. The method according to claim 1, wherein:

applying the first voltage results in a first energy being provided to the fluid firing unit;

applying the second voltage results in a second energy being provided to the fluid firing unit;

the first and second voltages being set such that the second energy is four percent to twenty-two percent higher than the first energy.

11. A non-transitory storage medium storing instructions that upon execution cause at least one processor to:

selectively operate a printing system in a printing mode and a recovery mode;

responsive to the printing system being operated in the printing mode, cause application of a first voltage to a resistor in a printhead to heat a printing fluid in a fluid chamber to expel a fluid drop from the fluid chamber; and responsive to the printing system being operated in the recovery mode, cause application of a second voltage higher than the first voltage to the resistor in the printhead to heat the fluid chamber to cause melting of a solid in the fluid chamber to expel the melted solid.

12. The non-transitory storage medium of claim 11, wherein the instructions upon execution cause the at least one processor to:

set a value of the second voltage based on information stored in a memory of the printing system.

13. The non-transitory storage medium of claim 12, wherein the setting of the value of the second voltage is based on the information stored in the memory that includes information selected from among the information relating to the printing system, the information relating to the printhead, and the information relating to a printing fluid used by the printing system.

14. A printing system comprising:

a controller to:

cause application of a first voltage to a fluid firing unit in a printhead to fire the fluid firing unit during a printing operation, in response to operating the fluid firing unit according to a printing mode; and cause application of a second voltage higher than the first voltage to the fluid firing unit to clean the fluid firing unit, in response to operating the fluid firing unit according to a recovery mode, wherein the controller is to operate the fluid firing unit in the recovery mode in response to detecting that the fluid firing unit has been idle for greater than a predetermined time threshold.

15. The printing system according to claim 14, further comprising:

a sensor to detect insertion of a new printhead, wherein the controller is to cause the fluid firing unit to operate in the recovery mode in response to detecting the insertion of the new printhead.

16. The printing system according to claim 15, wherein the controller is to operate the fluid firing unit in the recovery mode in response to detecting that an uncap time of the fluid firing unit exceeds a predetermined time threshold, the uncap time being a time when the fluid firing unit in the printhead remains uncapped.

17. The printing system according to claim 15, wherein the fluid firing unit comprises a resistor and a fluid chamber, and wherein the application of the second voltage to the resistor causes heating by the resistor of a printing fluid in the fluid chamber that is higher than heating by the resistor of a printing fluid in the fluid chamber when the first voltage is applied to the resistor.

18. The printing system according to claim 17, wherein the heating of the printing fluid in the fluid chamber when the second voltage is applied to the resistor is to cause melting of a solid in the fluid chamber and expulsion of the melted solid.

19. The printing system according to claim 14, wherein the controller is configured to set a value of the second voltage based on information selected from a type of the printing system, a type of the printhead, a type of a printing fluid used by the printing system, and an ambient temperature of the printing system.

20. The printing system according to claim 19, wherein the controller is configured to set the value of the second voltage by consulting a file stored in a memory of the printing system, the file including the information selected from the type of the printing system, the type of the printhead, the type of a printing fluid used by the printing system, and the ambient temperature of the printing system.

* * * * *